US007832577B2

(12) United States Patent
Shingle et al.

(10) Patent No.: US 7,832,577 B2
(45) **Date of Patent: *Nov. 16, 2010**

(54) CHILD-RESISTANT CLOSURE AND PACKAGE CONVERTIBLE TO NON-CHILD-RESISTANT OPERATION

(75) Inventors: John M. Shingle, Perrysburg, OH (US); Maurice R. Gnepper, Fremont, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 1347 days.

This patent is subject to a terminal disclaimer.

(21) Appl. No.: 11/190,034

(22) Filed: Jul. 26, 2005

(65) Prior Publication Data

US 2007/0023380 A1 Feb. 1, 2007

(51) Int. Cl.
*B65D 55/02* (2006.01)
*B65D 39/00* (2006.01)

(52) U.S. Cl. ..... 215/217; 215/341; 215/252

(58) Field of Classification Search ..... 215/217, 215/252, 331, 256, 341, 330, 343, 344; 220/789, 220/266

See application file for complete search history.

(56) References Cited

U.S. PATENT DOCUMENTS 3,739,933 A 6/1973 Degaetano
3,741,421 A 6/1973 Wittwer
3,857,508 A * 12/1974 LaBarge et al. ..... 215/221
3,880,313 A 4/1975 Akers
3,917,096 A 11/1975 Hedgewick
4,032,028 A 6/1977 Reiss et al.
4,128,184 A 12/1978 Northup
4,139,112 A 2/1979 Cooke (Continued)

FOREIGN PATENT DOCUMENTS

DE 2625875 A1 12/1977

(Continued)

OTHER PUBLICATIONS

U.S. Appl. No. 10/682,608, filed Oct. 9, 2003 Title: Closure Having User-Modifiable Functionality.

*Primary Examiner*—Robin Hylton
(74) *Attorney, Agent, or Firm*—Reising Ethington PC

(57) ABSTRACT

A package having child-resistant and non-child-resistant modes of operation includes a container having a neck finish with an open end, an external surface surrounding the open end and at least one external first engagement element spaced from the open end. A closure has a base portion, a skirt extending from the base portion, and at least one internal second engagement element on the skirt for engagement with the external first engagement element on the container neck finish in a child-resistant mode of operation. The skirt containing the second engagement element is severable from the base portion of the closure to convert the closure from a child-resistant mode of operation to a non-child-resistant mode of operation. A first annular element within the skirt is disposed for engagement with the external surface on the container neck finish to seal the package in the child-resistant mode of operation. A second annular element is disposed radially inwardly from the first annular element for engagement with the open mouth of the container neck finish to secure the closure to the container neck finish in the non-child-resistant mode of operation.

23 Claims, 3 Drawing Sheets

U.S. PATENT DOCUMENTS

| | | | | |
|---|---|---|---|---|
| 4,320,844 | A | 3/1982 | Cooper | |
| 4,325,487 | A | 4/1982 | Libit | |
| 4,337,869 | A | 7/1982 | Guinle | |
| 4,566,603 | A * | 1/1986 | Moore | 215/329 |
| 4,919,286 | A | 4/1990 | Agbay, Sr. | |
| 5,097,974 | A | 3/1992 | Rozenberg | |
| 5,129,533 | A * | 7/1992 | Loffler | 215/344 |
| 5,207,783 | A | 5/1993 | Burton | |
| 5,449,078 | A | 9/1995 | Akers | |
| 5,730,309 | A | 3/1998 | Jiradejnunt et al. | |
| 5,738,231 | A | 4/1998 | Montgomery | |
| 5,938,055 | A | 8/1999 | Philips et al. | |
| 6,102,227 | A | 8/2000 | Cochrane | |
| 6,253,937 | B1 | 7/2001 | Anderson | |
| 6,378,713 | B2 * | 4/2002 | Montgomery | 215/222 |
| 6,530,493 | B2 | 3/2003 | Anderson | |
| 6,660,349 | B1 | 12/2003 | Bourgeois | |
| 6,848,590 | B2 * | 2/2005 | Brozell et al. | 215/220 |
| 7,527,160 | B2 * | 5/2009 | Shingle | 215/228 |
| 2002/0043512 | A1 | 4/2002 | Sandor et al. | |
| 2003/0121877 | A1 | 7/2003 | Brozell et al. | |
| 2004/0173562 | A1 | 9/2004 | Wolfe | |
| 2005/0103741 | A1 * | 5/2005 | Shingle | 215/228 |
| 2006/0255004 | A1 * | 11/2006 | Shingle et al. | 215/332 |

FOREIGN PATENT DOCUMENTS

| | | |
|---|---|---|
| FR | 2863589 | 6/2005 |
| WO | WO 2005/035380 | 4/2005 |

* cited by examiner

CHILD-RESISTANT CLOSURE AND PACKAGE CONVERTIBLE TO NON-CHILD-RESISTANT OPERATION

The present disclosure relates to a child-resistant package that is convertible to non-child-resistant operation, to a closure for such a package, and to a method of making such a closure.

BACKGROUND AND SUMMARY OF THE DISCLOSURE

U.S. patent application Ser. No. 10/682,608 discloses a child-resistant package that includes a container having at least one external thread segment adjacent to the container mouth and an external deflectable locking element spaced from the container mouth. The closure has a peripheral skirt with a first portion having at least one internal thread segment for threaded engagement with the container thread segment, and a second portion frangibly connected to the first portion with a locking element for engagement with the deflectable locking element on the container. With the second portion of the closure skirt connected to the first portion, the package is adapted for child-resistant operation requiring deflection of the locking element on the container to release the closure for threaded disengagement from the container. When the second portion of the closure skirt is removed by a user, the closure can be merely threaded onto and off of the container in a non-child-resistant mode of operation. A general objective of the present disclosure is to provide a child-resistant package, a closure and/or a method of making such a closure, which are adapted for snap-cap operation in a non-child-resistant mode.

The present disclosure embodies a number of aspects that can be implemented separately from or in combination with each other.

A package having child-resistant and non-child-resistant modes of operation, in accordance with a first aspect of the present disclosure, includes a container having a neck finish with an open end, an external surface surrounding the open end and at least one external first engagement element spaced from the open end. A closure has a base portion, a skirt extending from the base portion, and at least one internal second engagement element on the skirt for engagement with the external first engagement element on the container neck finish in a child-resistant mode of operation. The skirt containing the second engagement element is severable from the base portion of the closure to convert the closure from a child-resistant mode of operation to a non-child-resistant mode of operation. A first annular element on the closure within the skirt is disposed for engagement with the external surface on the container neck finish to seal the package in the child-resistant mode of operation. A second annular element on the closure is disposed radially inwardly from the first annular element for engagement with the open mouth of the container neck finish in the non-child-resistant mode of operation, with the skirt removed from the base portion of the closure, to secure the closure to the container neck finish in the non-child-resistant mode of operation. The first and second annular elements preferably are of a flexible resilient plastic construction different from the plastic construction of the closure base portion and skirt, and preferably are molded in situ onto the inside surface of the closure base portion. A tamper band preferably, but not necessarily, is frangibly connected to the edge of the skirt and cooperates with a tamper bead on the container neck finish to sever the tamper band from the closure skirt when the closure is first removed from the container neck finish.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
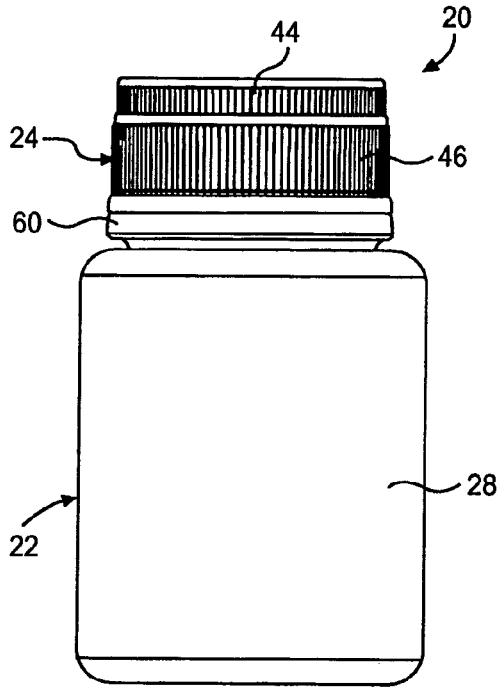
FIG. 1 is a side elevational view of a child-resistant package in accordance with an exemplary embodiment of the disclosure.
Figure 2:
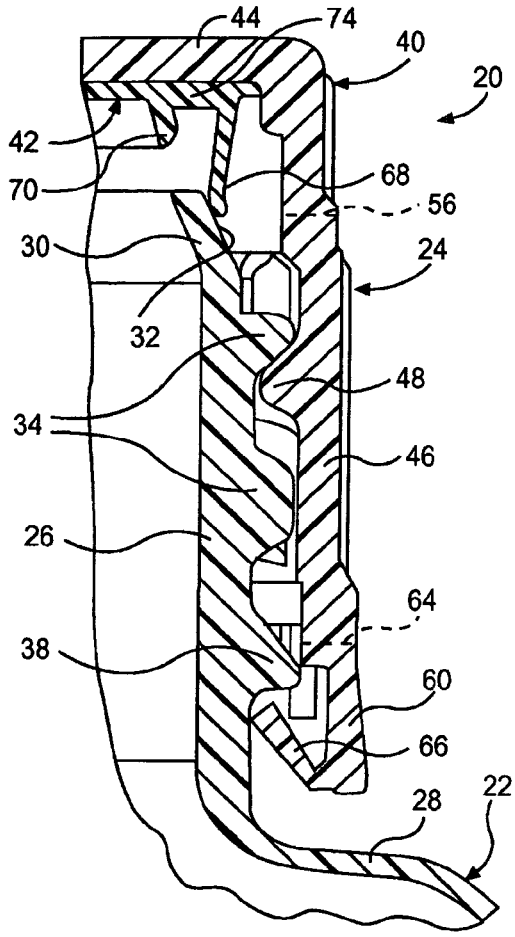
FIG. 2 is a fragmentary sectional view of the package in FIG. 1.
Figure 3:
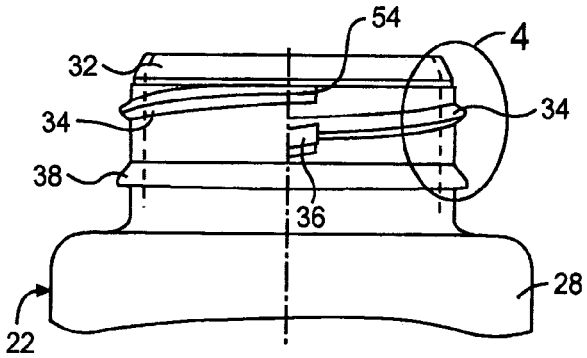
FIG. 3 is a fragmentary elevational view of the container in the package of FIGS. 1-2.
Figure 4:
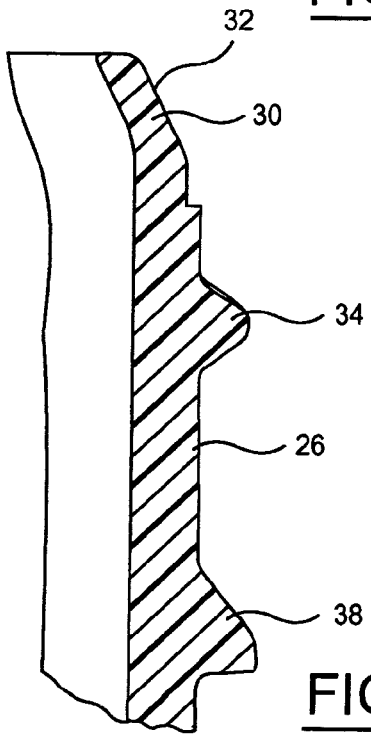
FIG. 4 is an enlarged sectional view of the portion of FIG. 3 within the area 4.

FIGS. 1-2 illustrate a package 20, in accordance with an exemplary embodiment of the present disclosure, as including a closure 24 applied to a container 22 in a child-resistant mode of operation. Container 22 (FIGS. 1-4) includes a generally cylindrical neck finish 26 that extends from a sidewall 28 of any suitable construction and geometry. Neck finish 26 has a wall section 30 extending from the upper end of the neck finish. (Directional words such as "upper" and "lower" are employed by way of description and not limitation with respect to the upright orientation of the package, container and closure illustrated in the drawings. Directional words such as "radial" and "axial" are employed by way of description and not limitation with respect to the axis of the container neck finish and/or the closure skirt as appropriate.) Wall section 30 has an external conical surface 32 that widens away from the open mouth at the upper end of the container. Wall section 30 preferably is a radially inwardly tapering conical wall section, but could be a cylindrical wall section having a conical outer surface 32. Wall surface 32 could be other than conical, such as part-toroidal. External thread segments 34 are disposed around the outer surface of container neck finish 26 at a position spaced from the open mouth of the container. Thread segments 34 preferably comprise a pair of external thread segments, as best seen in FIG. 3, each of which terminates in a lug 36 that extends axially from the end of the thread segment remote from the container mouth. The container neck finish may include an external bead 38 at a position spaced from the container mouth for providing tamper indication, as will be described. Container 22 preferably is of one-piece integrally molded plastic construction. By way of example only, container conical surface 32 may be at a nominal angle of 25° to the axis of the container neck finish.

Figure 5:
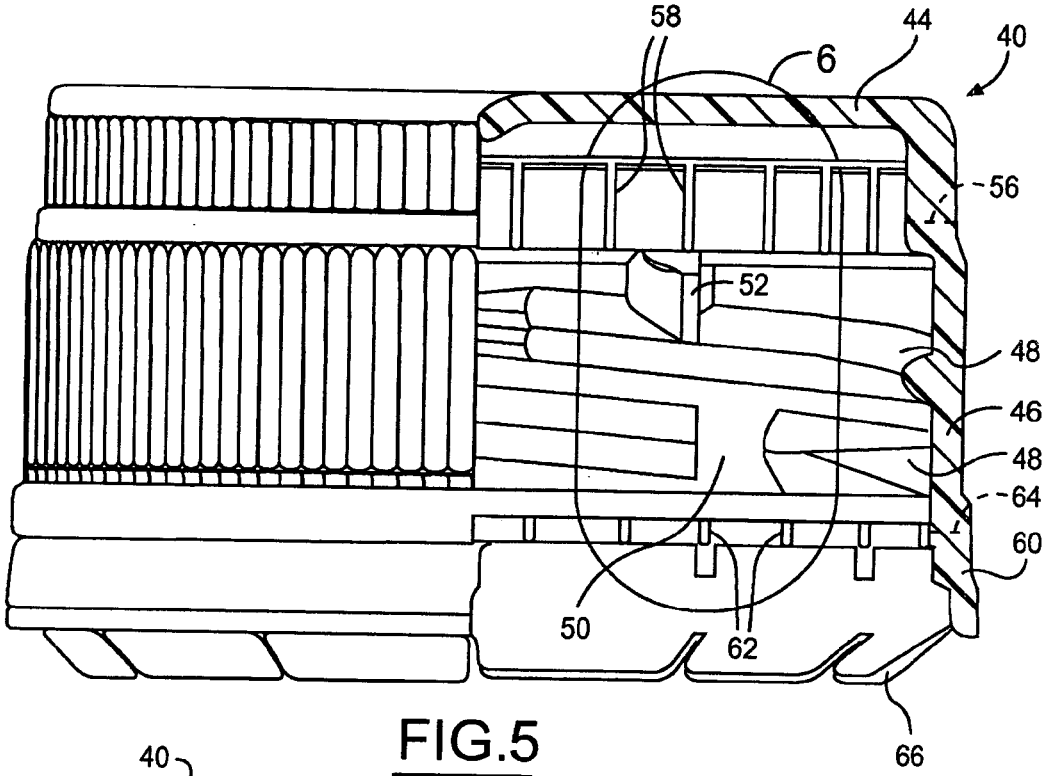
FIG. 5 is a partially sectioned elevational view of the closure shell as molded in the closure of FIGS. 1-2.
Figure 6:
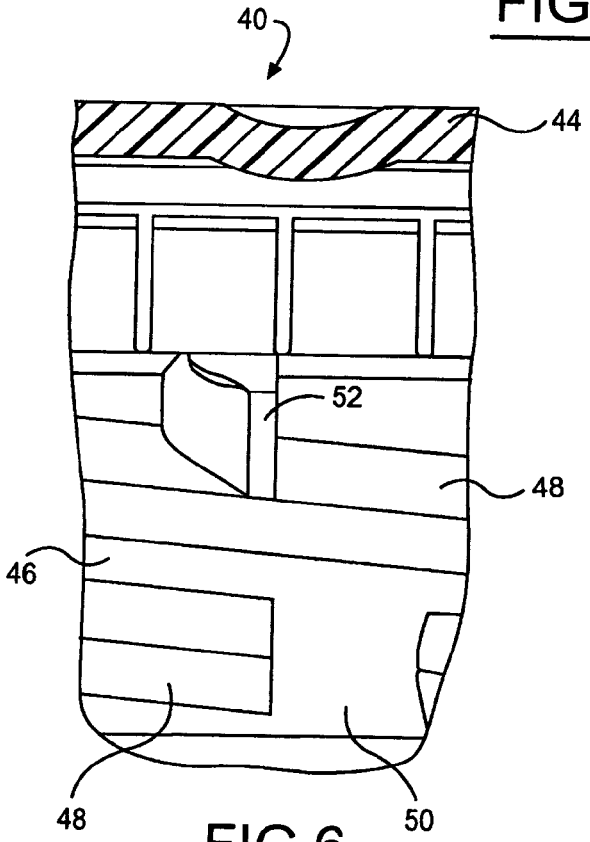
FIG. 6 is a fragmentary sectional view on an enlarged scale of the portion of FIG. 5 within the area 6.
Figure 7:
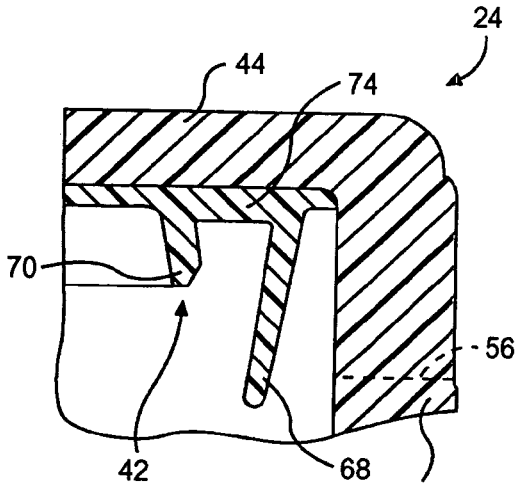
FIG. 7 is a fragmentary sectional view of the closure shell with a liner on the base portion of the closure shell.
Figure 8:
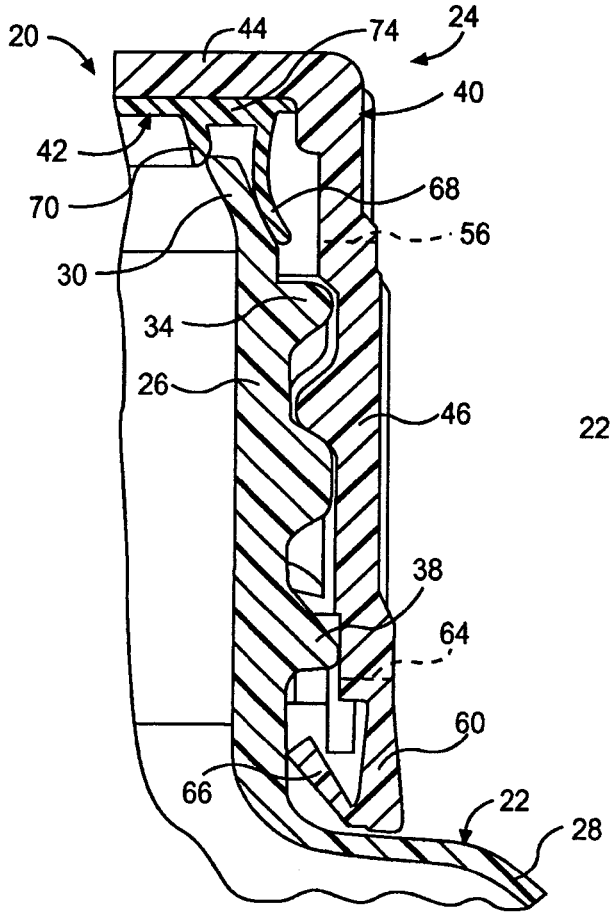
FIG. 8 is a fragmentary sectional view that is similar to that of FIG. 2 and illustrates the closure during removal from the container neck finish.

Closure 24 includes a closure shell 40 (FIGS. 5 and 6) having a liner 42 within the closure shell. FIGS. 5 and 6 illustrate closure shell 40 as molded, including a base portion 44 integrally connected to a peripheral skirt 46. At least one internal thread segment 48, and preferably a pair of internal thread segments, are molded onto skirt 46. Each internal thread segment 48 includes a pocket or gap 50 adjacent to the lower end of the thread segment—i.e., the end of the thread segment remote from base portion 44—for receiving an external lug 36 (FIG. 3) on the container neck finish. Each thread segment 48 preferably also includes a stop 52 adjacent to the upper end of the thread segment for engaging the end 54 (FIG. 3) of an external thread segment on the container neck finish to form a thread stop that prevents over-tightening of the closure onto the container neck finish.

Closure shell 40 preferably is fabricated (FIGS. 2, 5, 6 and 8) so that skirt 46 is frangibly separable from base portion 44. In the illustrated embodiment of the disclosure, leaders 58 are molded onto the inside surface of closure shell 40 and form frangible bridges when the closure shell is scored at 56. As an alternative, leaders 58 can be deleted, and the frangible bridges can formed in a single- or double-scoring operation. As another alternative, skirt 46 may be frangibly connected to the base portion 44 by bridges that are formed during the closure shell molding operation. In the illustrated exemplary embodiment of the disclosure, closure shell 40 also includes a tamper band 60 that is frangibly connected to the lower edge of skirt 46, such as by leaders 62 and a score along line 64. In the illustrated embodiment of the disclosure, a stop flange 66 extends from the lower edge of tamper band 60, and is inverted in a post-molding operation for engagement with bead 38 (FIGS. 2-4) on container neck finish 26 to sever band 60 from skirt 46 when the closure is first removed from the container neck finish.

Following molding of closure shell 40, liner 42 is formed on the inside surface of closure base portion 44. Liner 42 can be molded in situ in a suitable injection molding operation, or more preferably in a compression molding operation. As a less preferred third alternative, liner 42 could be fabricated separately and adhered or otherwise joined to the closure shell. Liner 42 has a first annular wall 68 that extends axially from base portion 44 radially inwardly from skirt 46. A second annular wall 70 is disposed radially inwardly from first annular wall 68. In the preferred embodiment of the disclosure, annular wall 68 is conical, angling inwardly and downwardly from base portion 44. Annular wall 70 preferably also is conical, angling downwardly and outwardly from base portion 44. Annular wall 70 is of shorter axial dimension than annular wall 68. Annular wall 70 preferably is of uniform thickness, such as 0.022 inch nominal thickness for example. Also by way of example, wall 70 may have a nominal angle of about 12° to the skirt axis. Annular wall 68 preferably tapers in thickness, such as from a nominal thickness of 0.022 inch at the upper end of the annular wall. Further by way of example only, the radially inner surface of wall 68 may have a nominal angle of 8° to the skirt axis, and the radially outer surface of wall 68 may have a nominal angle of 11° to the skirt axis. An annular band 74 preferably extends along the undersurface of shell base portion 44 between walls 68, 70. Walls 68, 70 and band 74 preferably are formed as a single unit, most preferably by compression molding of a plastic material different from, and preferably more flexible and resilient than, the material of closure shell 40. Closure shell 40 may be of any suitable relatively rigid molded plastic construction such as polypropylene. Liner 42 may be of any suitable relatively flexible resilient plastic construction such as ethylene vinyl acetate (EVA).

In a child-resistant mode of operation, closure 24 is threaded onto container neck finish 26 until neck finish lugs 36 register with internal thread pockets 50, at which point the lugs enter into the thread pockets. As this is occurring, liner wall 68 engages container neck finish wall surface 32, and the lower portion of wall 68 flexes radially outwardly along the neck finish surface as the closure is further applied onto the container neck finish. Stop flange 66 on tamper band 60, when provided, is received beneath bead 38 on the neck finish. At this fully applied position, closure wall 68 cooperates with container neck finish wall 32 both to seal the package and to bias the closure upwardly away from the container neck finish so as to hold internal thread pockets 50 over external lugs 36. Stop lugs 52 (FIGS. 5 and 6) cooperate with thread ends 54 (FIG. 3) to prevent over-tightening of the closure.

To remove the closure from the container in this child-resistant mode of operation, force must be applied to the closure, against the force of annular wall 68, to push the closure downwardly over the neck finish so that the internal thread pockets 50 on the closure skirt clear the external lugs 36 on the container neck finish. With the thread lugs disengaged from the thread pockets, the closure can be unthreaded from the container neck finish. Initial unthreading of the closure from the container neck finish brings stop flange 66 into engagement with neck finish bead 38 and ruptures the frangible bridges at line 64, so that tamper band 60 is separated from closure skirt 46 to indicate that the package has been opened.

Figure 9:
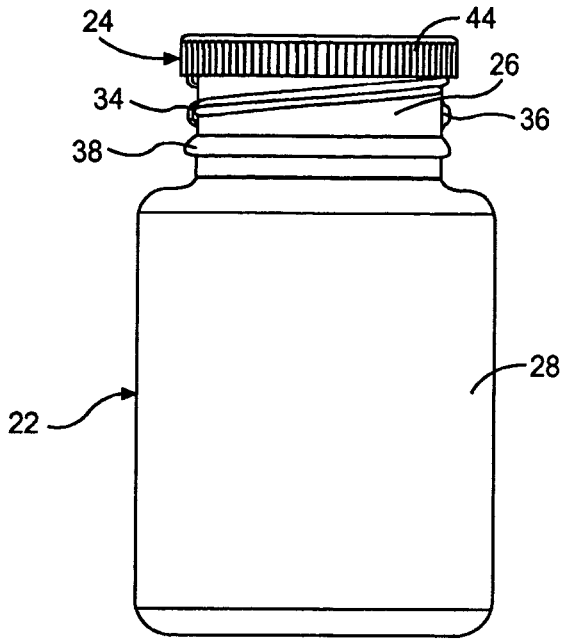
FIG. 9 is an elevational view of the package of FIG. 1 in a non-child-resistant mode of operation.
Figure 10:
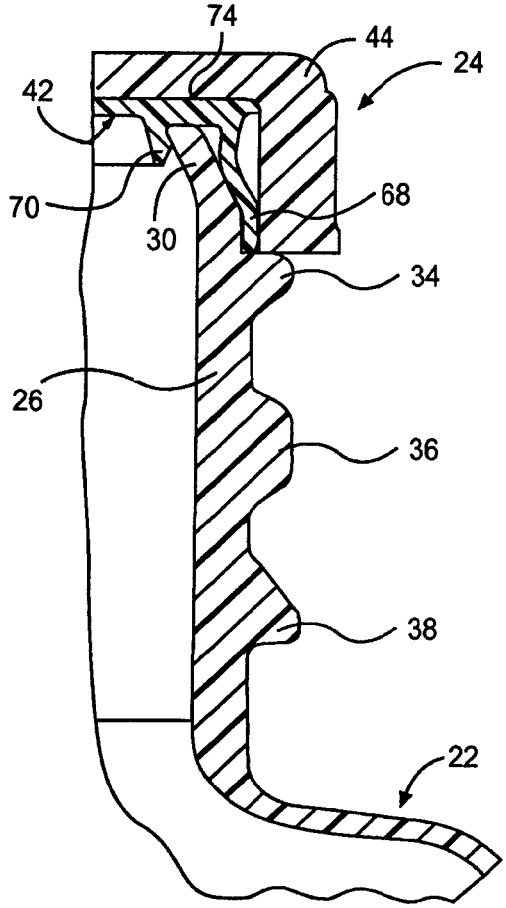
FIG. 10 is a fragmentary sectional view of the package in FIG. 9.

To convert closure 24 to a non-child-resistant mode of operation, the closure is removed from the container and closure skirt 46 is severed along line 56 from closure base portion 44. With the closure thus reconfigured as illustrated in FIGS. 9 and 10, liner wall 70 is receivable by snap-fit within the open mouth of the container. Wall 70 preferably is circumferentially continuous, so that wall 70 seals against the inside surface of neck finish wall 30 around the container mouth. Wall 68 provides a secondary seal in the non-child-resistant mode of operation. Annular band 74 of liner material engages the upper edge of the container neck finish for further sealing engagement with the container neck finish in the non-child-resistant mode of operation.

There thus have been disclosed a child-resistant package, a closure and a method of making a closure that are convertible to non-child-resistant operation, and that otherwise fully satisfy all of the objects and aims previously set forth. The disclosure has been presented in conjunction with a presently preferred exemplary embodiment, and a number of modifications and variations have been discussed. Other modifications and variations readily will suggest themselves to persons of ordinary skill in the art in view of the foregoing discussion. The disclosure is intended to embrace all such modifications and variations as fall within the spirit and broad scope of the appended claims.

The invention claimed is:

1. A package having child-resistant and non-child-resistant modes of operation, which includes:

a container having a neck finish with an open end, an external surface surrounding said open end and at least one external first engagement element spaced from said open end, a closure having a base portion, a skirt extending from said base portion, at least one internal second engagement element on said skirt for engagement with said external first engagement element on said container neck finish in a child-resistant mode of operation, said skirt containing said second engagement element being severable from said base portion to convert said closure from a child-resistant mode of operation to a non-child-resistant mode of operation, and a first annular element within said skirt for sealing engagement with said external surface on said neck finish to seal said package in said child-resistant mode of operation and to bias said closure away from said neck finish, and a second annular element radially inward from said first annular element for snap-fit engagement with said open end in said non-child-resistant mode of operation with said skirt removed from said base portion to secure said closure to said container neck finish in said non-child-resistant mode of operation.

2. The package set forth in claim 1 wherein said first and second annular elements are of different material construction from said base portion and said skirt.

3. The package set forth in claim 2 wherein said base portion and said skirt are of relatively rigid plastic construction, and wherein said first and second annular elements are of relatively flexible resilient plastic construction.

4. The package set forth in claim 3 wherein said closure includes an annular band of said relatively flexible resilient plastic construction extending between said first and second annular elements for sealing engagement with an end of said container neck finish in said non-child-resistant mode of operation.

5. The package set forth in claim 4 wherein said first and second annular elements and said band are molded in situ on said base portion within said skirt.

6. The package set forth in claim 3 wherein said first engagement element on said container neck finish includes at least one external thread segment, wherein said second engagement element on said skirt includes at least one internal thread segment, wherein one of said thread segments includes a lug and the other of said thread segments includes a pocket for receiving said lug, and wherein said first annular element cooperates with said external surface both to seal said package and to bias said lug into said pocket, such that said closure must be pressed over said neck finish against the force of said first annular element until said lug clears said pocket to unthread said closure from said container neck finish.

7. The package set forth in claim 6 wherein said lug is disposed on said at least one external thread segment and said pocket is disposed on said at least one internal thread segment.

8. The package set forth in claim 7 wherein said at least one internal thread segment includes a thread stop that cooperates with an end of said at least one external thread segment to prevent over-tightening of said closure onto said container neck finish.

9. The package set forth in claim 3 including a tamper band frangibly connected to an edge of said skirt and an external bead on said container neck finish for engagement with said tamper band to separate said tamper band from said skirt upon first removal of said closure from said container neck finish.

10. A child-resistant package that is convertible to non-child-resistant operation, which includes:

a container having a neck finish with an open end, an external conical surface surrounding said open end, and at least two external thread segments spaced from said open end, a closure having a base portion, a skirt frangibly connected to said base portion, and at least two internal thread segments on said skirt, a first annular element on said base portion radially inward from said skirt for sealing engagement with said external conical surface on said neck finish both to bias said closure away from said neck finish and to seal said package, a second annular element on said base portion radially inward from said first annular element for engagement with said open end of said container neck finish, said first and second annular elements being formed in situ on said base portion of different material construction than said base portion, said internal and external thread segments having lugs and pockets that prevent unthreading of said closure from said container neck finish in a child-resistant mode of operation absent a force against said first annular element sufficient to clear said lugs from said pockets, said skirt being removable from said base portion to convert said package to a non-child-resistant mode of operation in which said second annular element is receivable by snap-fit engagement within said open end to secure said closure to said container neck finish.

11. The package set forth in claim 10 including a tamper band frangibly connected to an edge of said skirt and an external bead on said container neck finish for engagement with said tamper band to separate said tamper band from said skirt upon first removal of said closure from said container neck finish.

12. The package set forth in claim 10 wherein said base portion and said skirt are of relatively rigid plastic construction, and wherein said first and second annular elements are of relatively flexible resilient plastic construction.

13. The package set forth in claim 12 wherein said closure includes an annular band of said relatively flexible resilient plastic construction extending between said first and second annular elements for sealing engagement with an end of said container neck finish in said non-child-resistant mode of operation.

14. The package set forth in claim 13 wherein said first and second annular elements and said band are molded in situ on said base portion within said skirt.

15. A closure that includes:

a closure shell of one-piece integrally molded relatively rigid plastic construction including a base portion, a skirt frangibly connected to said base portion, at least one internal thread segment on said skirt, and a child-resistance lock element on said internal thread segment, and a liner of relatively flexible resilient plastic construction molded in situ on said base portion, said liner having a first annular wall spaced radially inwardly from said skirt and a second annular wall spaced radially inwardly from said first annular wall, said first annular wall being positioned for external sealing engagement with a container neck finish when the closure is threaded onto the neck finish and for biasing said closure away from the container neck finish, said second annular wall being positioned for internal snap-fit engagement with a container open end when said skirt is frangibly removed from said base portion.

16. The closure set forth in claim 15 wherein said liner includes an annular band extending between said first and second annular walls for sealing engagement with an end surface of the container neck finish.

17. The closure set forth in claim 16 wherein said closure shell includes a tamper band frangibly connected to said skirt.

18. The package set forth in claim 1 wherein said first annular element provides a secondary seal in the non-child-resistant mode of operation.

19. The package set forth in claim 18 wherein said first annular element is disposed in contact between said skirt and said neck finish in the non-child-resistant mode of operation.

20. The package set forth in claim 10 wherein said first annular element provides a secondary seal in the non-child-resistant mode of operation.

21. The package set forth in claim 20 wherein said first annular element is disposed in contact between said skirt and said neck finish in the non-child-resistant mode of operation.

22. The package set forth in claim 15 wherein said first annular wall provides a secondary seal in the non-child-resistant mode of operation.

23. The package set forth in claim 22 wherein said first annular wall being positioned for contact between said skirt and the container neck finish in the non-child-resistant mode of operation.

* * * * *